US007588447B1

(12) United States Patent
Ni

(10) Patent No.: US 7,588,447 B1
(45) Date of Patent: Sep. 15, 2009

(54) SAFETY RECEPTACLE WITH TAMPER RESISTANT SHUTTER

(75) Inventor: Lidong Ni, Yueqing (CN)

(73) Assignee: Wenzhou MTLC Electrical Appliances Co., Ltd., Yuenqing, Zhejiang (CN)

( * ) Notice: Subject to any disclaimer, the term of this patent is extended or adjusted under 35 U.S.C. 154(b) by 0 days.

(21) Appl. No.: 12/050,925

(22) Filed: Mar. 18, 2008

(51) Int. Cl.
*H01R 13/44* (2006.01)

(52) U.S. Cl. ..... 439/137

(58) Field of Classification Search ..... 439/135–145
See application file for complete search history.

(56) References Cited

U.S. PATENT DOCUMENTS

| | | | | | |
|---|---|---|---|---|---|
| 4,271,337 | A * | 6/1981 | Barkas | 200/51.09 |
| 4,379,607 | A * | 4/1983 | Bowden, Jr. | 439/137 |
| 4,544,219 | A * | 10/1985 | Barkas | 439/137 |
| 4,822,290 | A * | 4/1989 | Cauley et al. | 439/137 |
| 4,867,694 | A * | 9/1989 | Short | 439/137 |
| 5,006,075 | A * | 4/1991 | Bowden, Jr. | 439/137 |
| 5,915,981 | A * | 6/1999 | Mehta | 439/137 |
| 6,056,564 | A * | 5/2000 | Huang | 439/145 |
| 6,086,391 | A * | 7/2000 | Chiu | 439/145 |
| 6,217,353 | B1 * | 4/2001 | Yu-Tse | 439/145 |
| 6,238,224 | B1 * | 5/2001 | Shao | 439/137 |
| 6,422,880 | B1 * | 7/2002 | Chiu | 439/137 |
| 6,537,089 | B1 * | 3/2003 | Montague | 439/145 |
| 6,555,771 | B2 * | 4/2003 | Shao | 200/51 R |
| 6,749,449 | B2 * | 6/2004 | Mortun et al. | 439/188 |
| 6,776,630 | B1 * | 8/2004 | Huang | 439/137 |
| 6,786,745 | B1 * | 9/2004 | Huang | 439/137 |
| 6,814,594 | B1 * | 11/2004 | Huang | 439/137 |
| 6,893,275 | B2 * | 5/2005 | Ng et al. | 439/137 |
| 7,179,992 | B1 * | 2/2007 | Packard et al. | 174/53 |
| 7,355,117 | B2 * | 4/2008 | Castaldo et al. | 174/53 |
| 7,455,538 | B2 * | 11/2008 | Germain | 439/137 |
| 2004/0147148 | A1 * | 7/2004 | Ng et al. | 439/137 |
| 2007/0049077 | A1 * | 3/2007 | Germain | 439/135 |
| 2007/0049079 | A1 * | 3/2007 | Nalwad et al. | 439/137 |
| 2007/0111569 | A1 * | 5/2007 | Germain et al. | 439/137 |
| 2007/0114053 | A1 * | 5/2007 | Castaldo et al. | 174/53 |

* cited by examiner

*Primary Examiner*—Ross N Gushi

(57) ABSTRACT

The disclosed embodiments are directed to a apparatus that includes a frame and a shutter device located within the frame, the shutter device being configured to simultaneously block openings for at least a hot connector element and a neutral connector element of an electrical receptacle when forces are unequally applied to the shutter device through openings corresponding to the at least hot and neutral connector elements.

21 Claims, 21 Drawing Sheets

SAFETY RECEPTACLE WITH TAMPER RESISTANT SHUTTER

BACKGROUND

1. Field

The aspects of the disclosed embodiments generally relate to electrical protection devices, and particularly to an electrical receptacle with a protective shutter mechanism.

2. Background

Electrical receptacles are widely used in daily life. Common electrical receptacles do not provide protective features to prevent foreign objects from being inserted into the openings of the receptacle. As such, it can be relatively easy to insert objects such as paper clips, screwdriver blades or iron wire into the receptacle contact openings. Unfortunately, this can often result in electric shock, burns, or electrocution.

In one approach, the electrical receptacles in the wiring devices are equipped with shuttered openings that prevent the insertion of foreign objects into the receptacle contact openings. The mechanism comprises a spring element that pushes the plastic chock block element, shuttering the openings. One drawback to this approach is the shutters will open at the forced insertion of foreign object into only one opening, exposing a person to a shock hazard. It would be advantageous to provide a shutter mechanism that will not open, and block exposure to the receptacle contacts, upon the insertion of an object into only one of the openings.

SUMMARY

In one aspect, the disclosed embodiments are directed to an apparatus. In one embodiment, the apparatus includes a frame and a shutter device located within the frame, the shutter device being configured to simultaneously block openings for at least a hot and neutral connectors of an electrical receptacle when forces are unequally applied to the shutter device through openings corresponding to the at least hot and neutral connectors.

In another aspect, the disclosed embodiments are directed to an apparatus. In one embodiment, the apparatus includes a frame configured to be inserted into an electrical receptacle, a first shutter member slidingly mounted in the frame, the first shutter member having a first ramp member and a first receptacle blocking member, a second shutter member slidingly mounted in the frame, the second shutter member having a second ramp member located in front of the first blocking member and a second receptacle blocking member located behind the first ramp member and a first resilient member disposed between the first shutter member and the frame and a second resilient member disposed between the second shutter member and the frame wherein the first and second shutter members are configured to simultaneously block a neutral and hot opening of the electrical receptacle when a force is exerted on either of the first or second ramp members.

In yet another aspect, the disclosed embodiments are directed to an electrical receptacle. The electrical receptacle includes a housing for providing at least a hot and neutral receptacle to a power source, a cover attached to the housing having at least a first and second openings for allowing connection to a corresponding one of the hot or neutral receptacle, and a shutter device located within the housing, the shutter device being configured to block both the first and second openings when forces are unequally applied to the shutter device through the first and second openings.

DETAILED DESCRIPTION OF THE EXEMPLARY EMBODIMENT(S)

Figure 1:
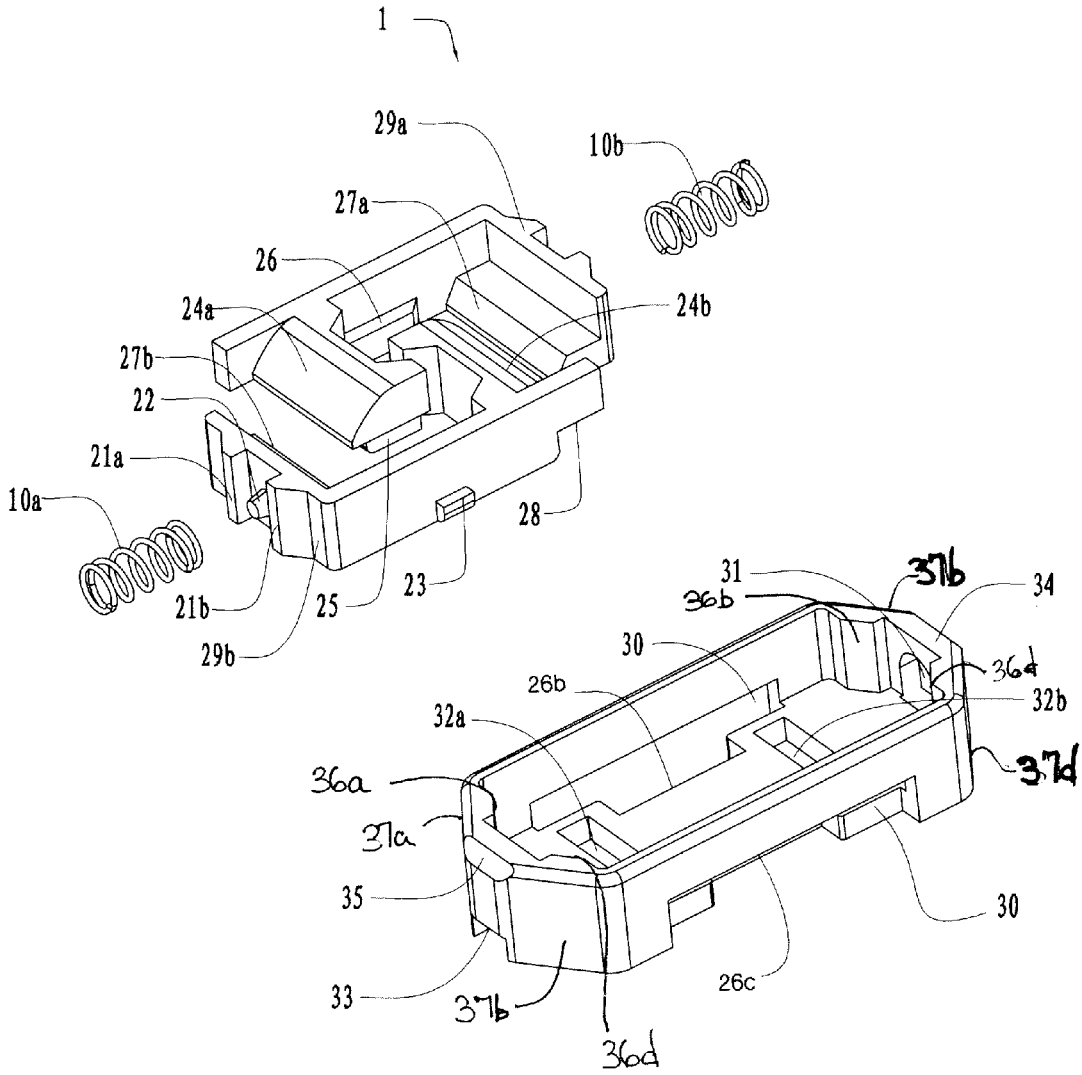
FIG. 1 is an exploded component view of one example of the protective shutter assembly of the disclosed embodiments.

Referring to FIG. 1, a protective shutter assembly 1 for an electric receptacle is shown. Although the embodiments disclosed will be described with reference to the embodiments shown in the drawings, it should be understood that the embodiments disclosed can be embodied in many alternate forms. In addition, any suitable size, shape or type of elements or materials could be used.

The aspects of the disclosed embodiments are directed to a protective shutter assembly for an electrical receptacle, which can be embodied in a cover assembly for the electrical receptacle. In one embodiment, a protective shutter mechanism in the protective shutter assembly shutters the corresponding receptacle opening, and will open only when plug blades are inserted into both receptacle openings at substantially the same time. It is a feature of the disclosed embodiments that the protective shutter assembly will only operate to allow the complete insertion of plug blades into the receptacle openings, when two plug blades are inserted into both openings in a balanced manner. This effectively prevents the insecurity that the shutters will open at the forced insertion of a foreign object into only one opening.

Referring to FIG. 1, in one embodiment, the protective shutter assembly 1 comprises a framed mechanism including two shutter members 29*a*, 29*b*, a registration member 34, also referred to herein as a frame, and two resilient members 10*a*, 10*b*. Each resilient member 10*a*, 10*b*, which in one embodiment comprise springs, is disposed between a respective shutter member 29*a*, 29*b* and the registration member 34 to form a shutter device. While the resilient members are shown as coil springs in the figures, in other embodiments the resilient members may be any suitable resilient members including, but not limited to, leaf springs and spring washers. Movement of each shutter member 29*a*, 29*b*, with respect to the registration member 34, will either compress or allow the extension of the corresponding resilient member 10*a*, 10*b*.

Figure 20:
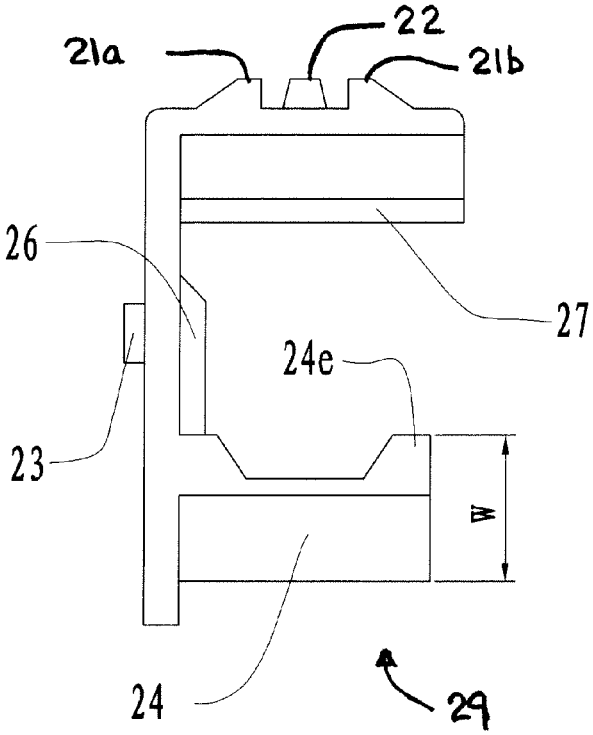
FIG. 20 illustrates one example of a shutter member of a protective shutter assembly of the disclosed embodiments.
Figure 21:
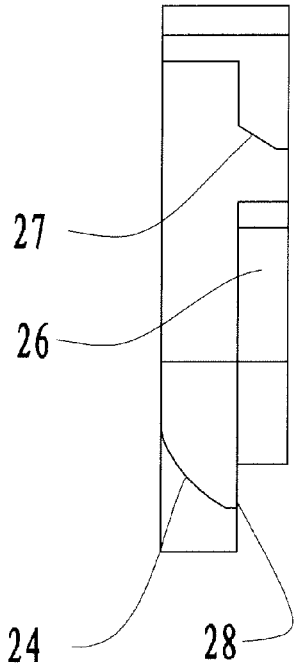
FIG. 21 illustrates a side view of the shutter member shown in FIG. 20.

Referring to FIG. 20, one example of a shutter member 29 is illustrated. As shown in FIG. 20, the shutter member 29 includes a spring registration protrusion 22, a shutter ramp 24, and spring registration blocks 21*a* and 21*b*. In other embodiments, the spring may be registered against the shutter member 29 in any suitable manner such as through recesses. The shutter member 29 also includes a longitudinal retaining pocket 25 and longitudinal retaining orbit 26, as shown in FIG. 1. The longitudinal retaining pocket 25 is configured to move in longitudinal retaining orbit 26 to prevent shutter members 29*a* and 29*b* from moving side to side. As also shown in FIGS. 20 and 21, the shutter member 29 also includes longitudinal retaining lip 23, shutter blocking member 27 and registration pocket 28.

Figure 2:
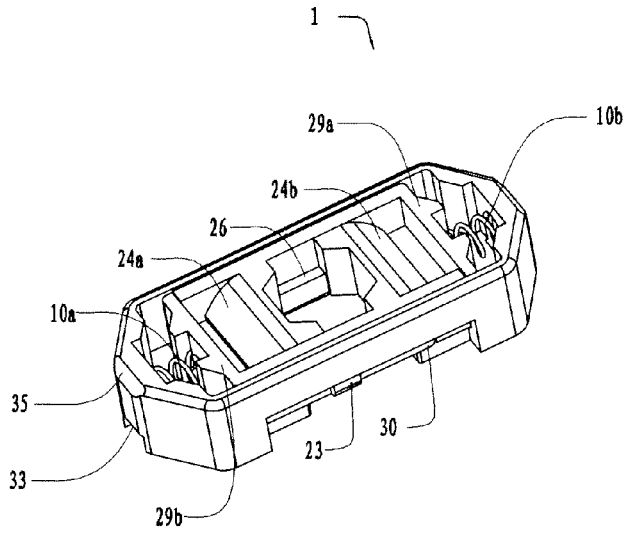
FIG. 2 is an axonometric view of a protective shutter assembly of the disclosed embodiments.
Figure 3:
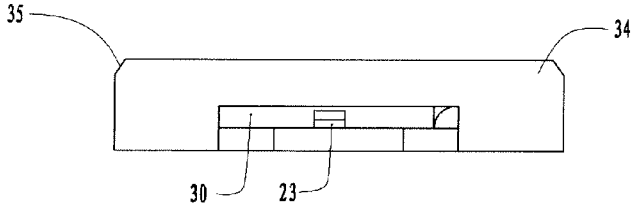
FIG. 3 is a side elevation view of the protective shutter assembly shown in FIG. 2.
Figure 22:
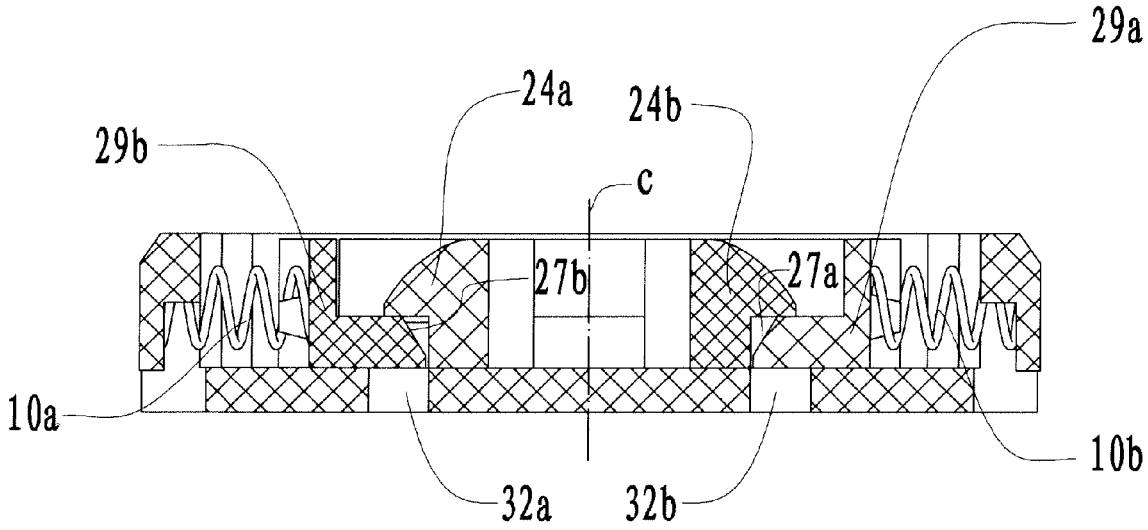
FIG. 22 is a cross-sectional view of the protective shutter assembly illustrated in FIG. 2.

In the embodiment shown in FIGS. 1 and 22, the base of the registration member 34 includes two polarity receptacle openings 32*a*, 32*b* and a shutter orbit or slot 30. The slot 30 is configured to accept the longitudinal retaining lips 23 of the shutter members 29*a*, 29*b* for retaining the shutter members 29*a*, 29*b* within the registration member 34 while allowing sliding movement of the shutter members 29*a*, 29*b* within the registration member 34 as can be seen in FIGS. 2 and 3. The polarity receptacle openings 32*a* and 32*b* are generally configured to receive corresponding electrical blades or contacts. As illustrated in FIG. 1, the registration member 34 may also include recesses 26*b*, 26*c* for slidingly engaging the longitudinal retaining orbit 26 of a respective one of the shutter members 29*a*, 29*b*. The size and configuration of the openings 32*a* and 32*b* can be configured to any suitable number or openings having any suitable size and shape.

In one embodiment, on each side or end of the registration member 34, there is a side chamfer 35, installation pocket 33 and spring registration hole 31 for easy installation and assembly of the shutter members 29*a* and 29*b*, the resilient members 10*a*, 10*b* and the registration member 34 to form the protective shutter assembly 1 of the disclosed embodiments. As shown in FIG. 1, the registration member 34 also includes angled wall members 36*a*-36*d* in each corner region, the angled wall members 36*a*-36*d* configured to restrict movement of each respective shutter member 29*a*, 29*b* within the registration member 34. The registration member 34 also includes a chamfer 37*a*-37*d* that allows for a more compact construction. Chamfer 37*a*-37*d* can also be configured to engage a corresponding member 402 in the cover part 46, as shown in FIG. 6, to assist in the alignment of the registration member 34 in the cover part 46 as well as restrict movement of the registration member 34 in the cover part 46.

Figure 4:
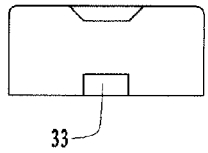
FIG. 4 is an end elevation view of the protective shutter assembly shown in FIG. 2.
Figure 5:
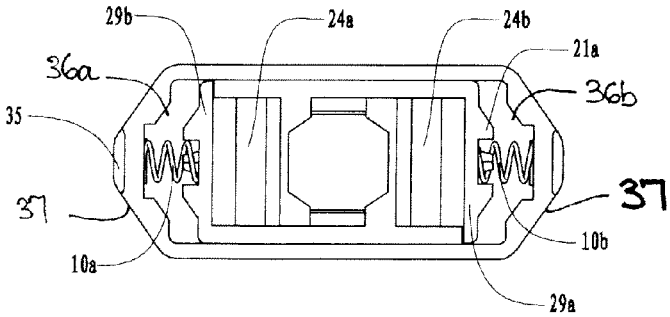
FIG. 5 is a plan view of the protective shutter assembly shown in FIG. 2.

FIGS. 2 and 22 illustrates one example of a protective shutter assembly 1 with the shutter members 29*a*, 29*b* and resilient members 10*a*, 10*b* assembled within the registration member 34. FIG. 3 is a side view of the assembly 1 of FIG. 2, while FIG. 4 is an end view of the assembly 1 shown in FIG. 2. FIG. 5 is a top plan view of the assembly 1 shown in FIG. 2.

Figure 6:
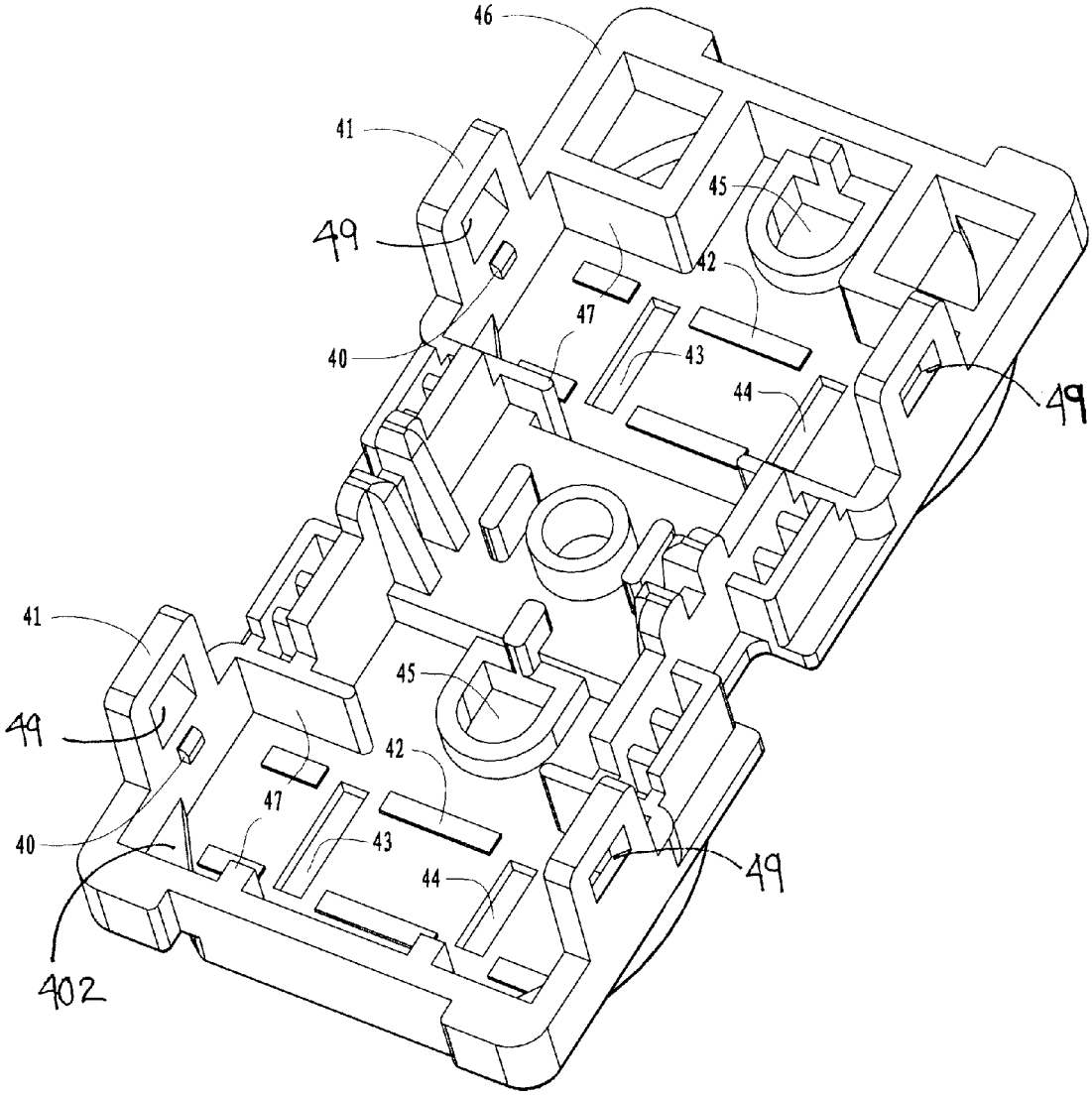
FIG. 6 is a plan view of an internal portion of one embodiment of a cover assembly for the protective shutter assembly of the disclosed embodiments.
Figure 7:
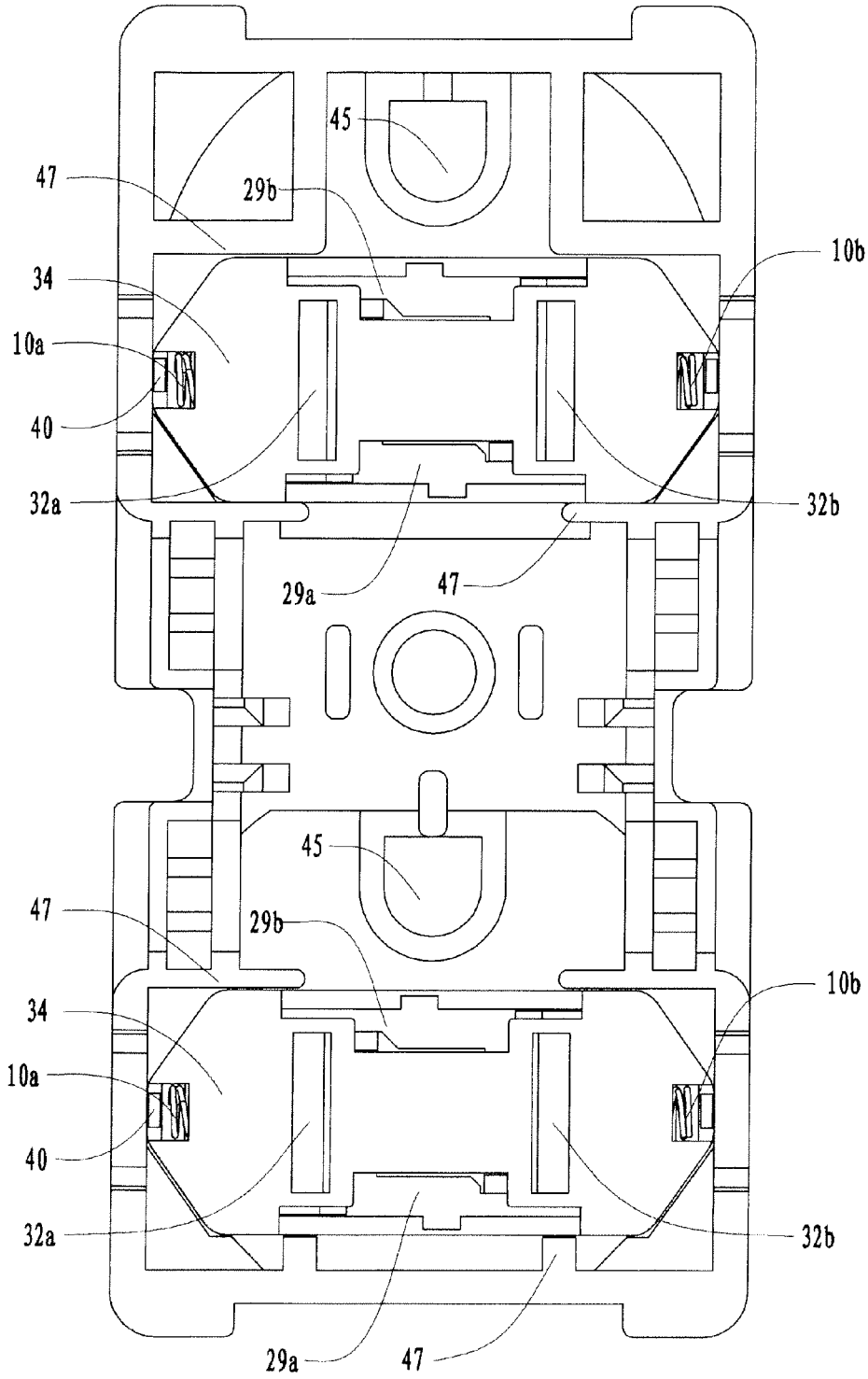
FIG. 7 is a plan view of an internal portion of the cover assembly shown in FIG. 6 including the protective shutter assembly of FIG. 2 embodied therein.
Figure 13:
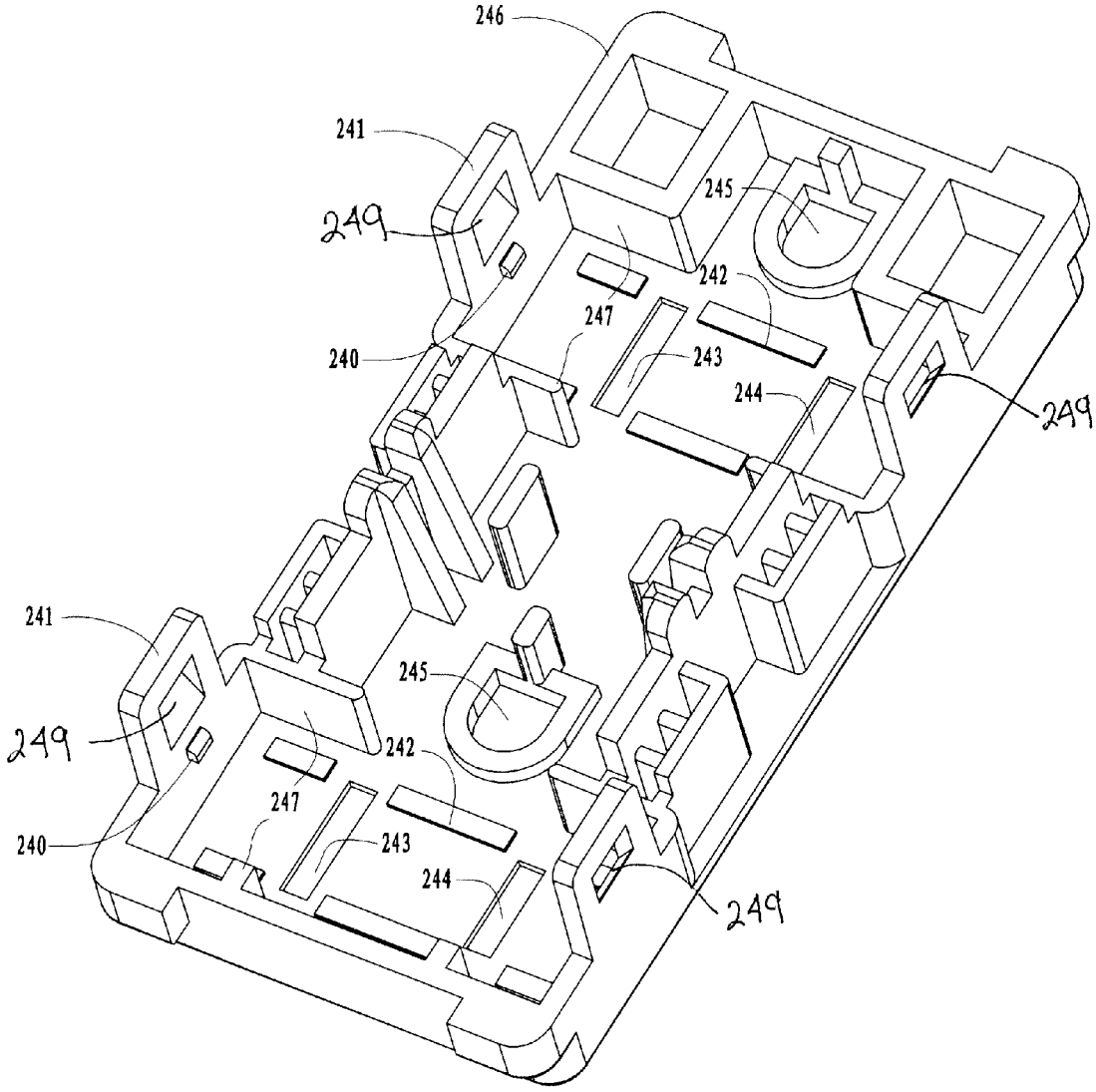
FIG. 13 is a plan view of an internal portion of an embodiment of a cover assembly.
Figure 14:
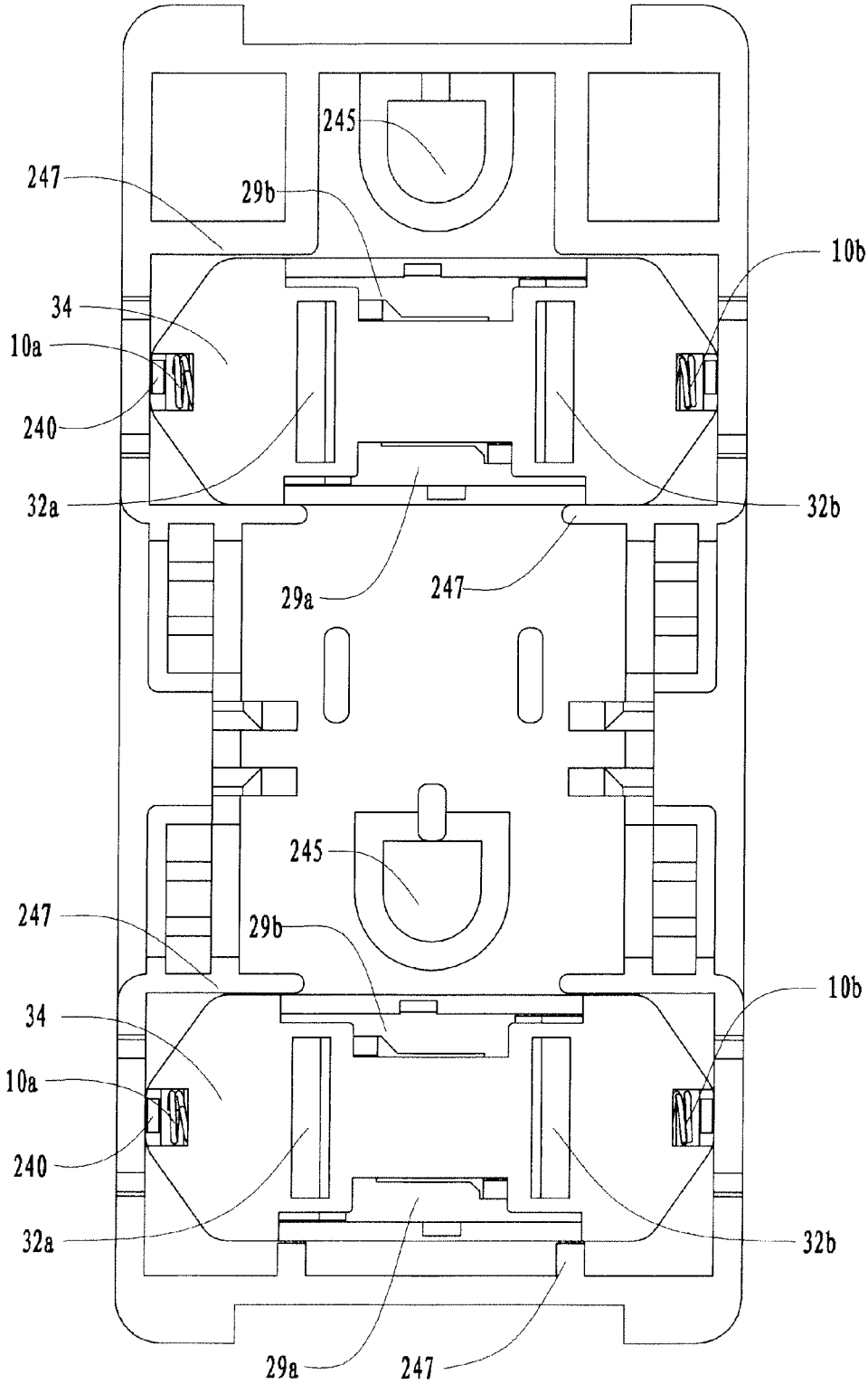
FIG. 14 is a plan view of an internal portion of the cover assembly illustrated in FIG. 13 with a protective shutter assembly shown in FIG. 2 embodied therein.
Figure 15:
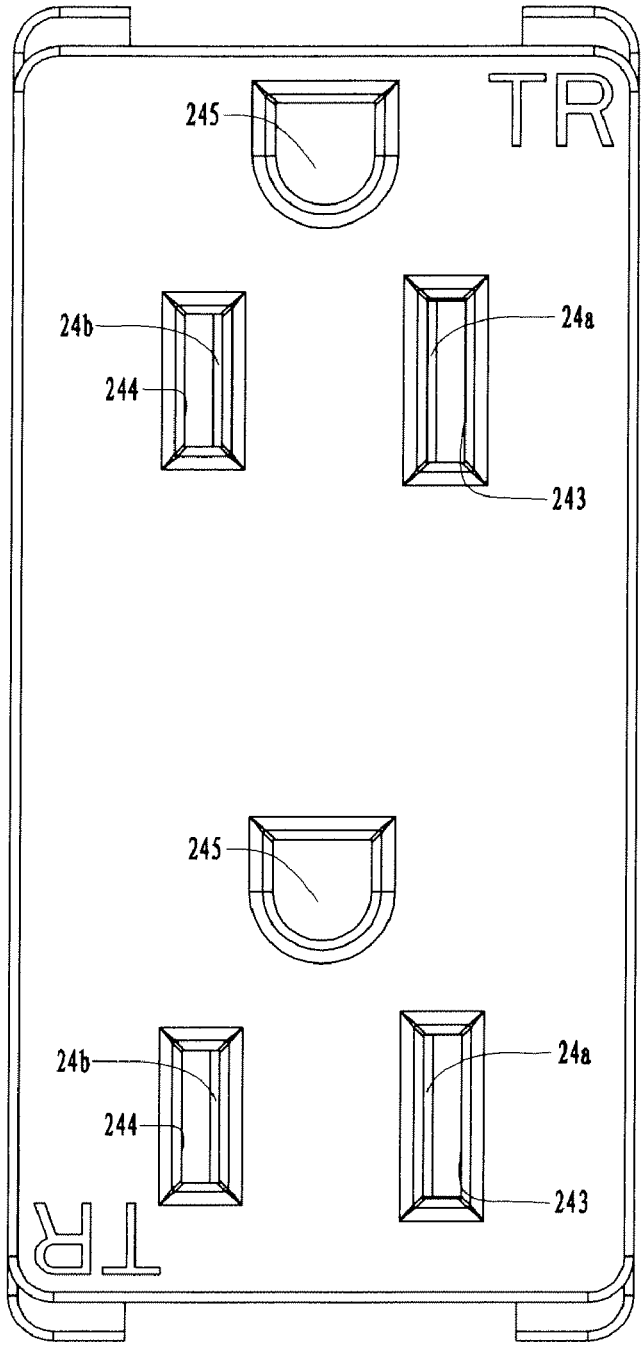
FIG. 15 is a plan view of the external portion of the cover assembly shown in FIG. 13 with a protective shutter assembly as shown in FIG. 2 embodied therein.
Figure 16:
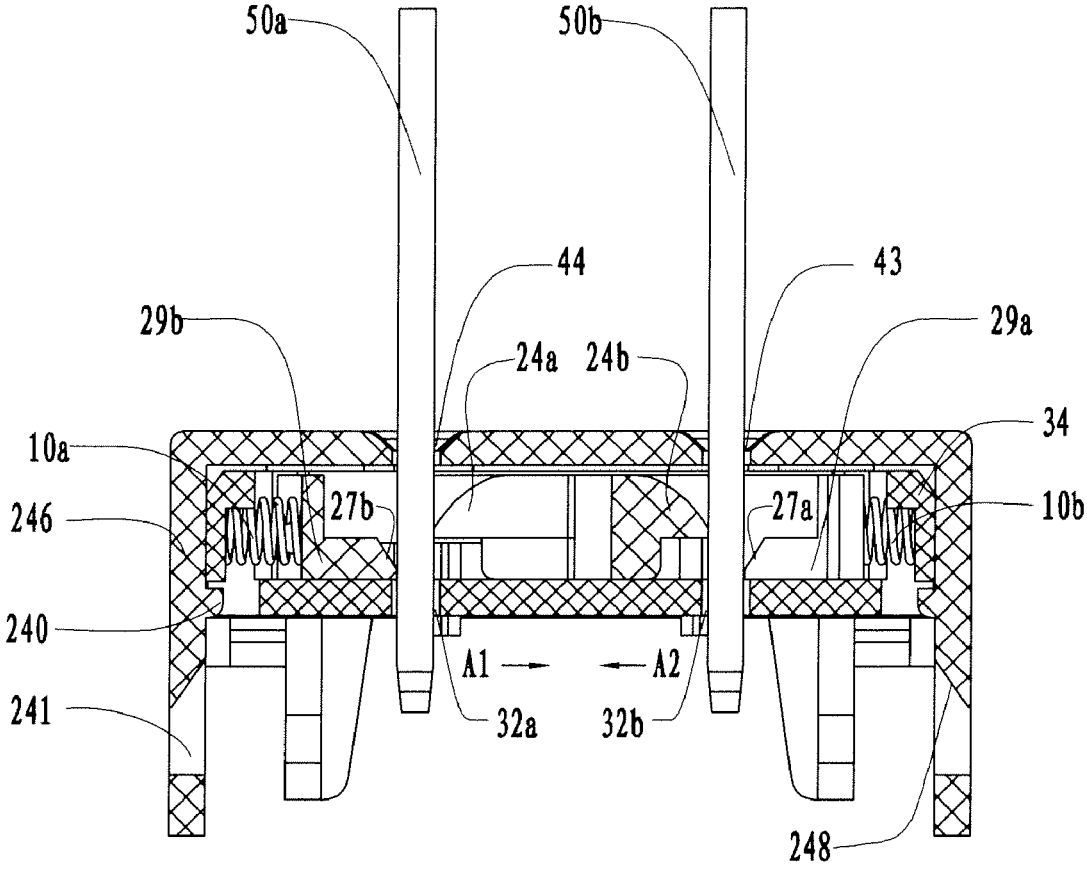
FIG. 16 is a cross-sectional view of the device illustrated in FIG. 15, with plug blades inserted into each of the receptacle openings.
Figure 17:
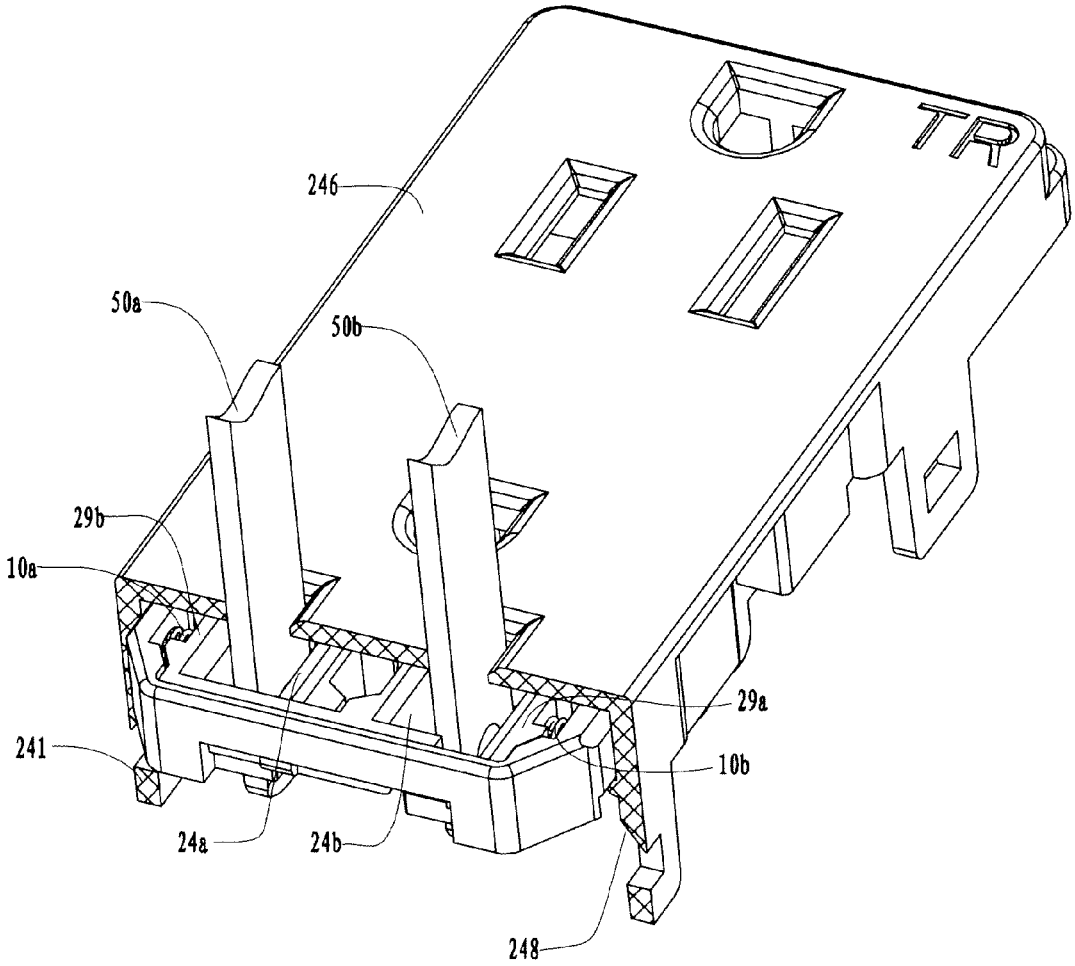
FIG. 17 is an axonmetric view of the device illustrated in FIG. 16.
Figure 18:
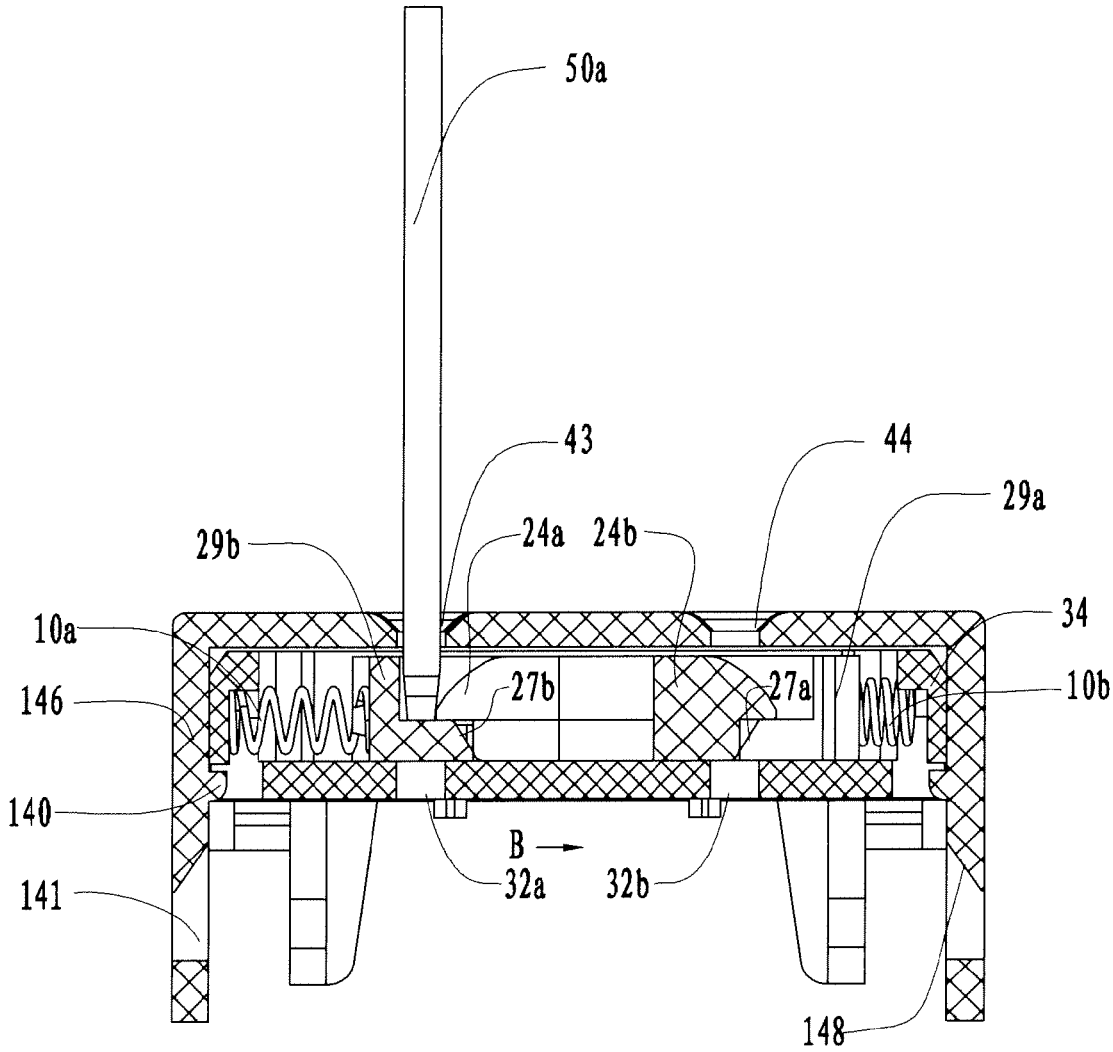
FIG. 18 is a cross-sectional view of the device of FIG. 15 with only one plug blade inserted into only one receptacle opening.
Figure 19:
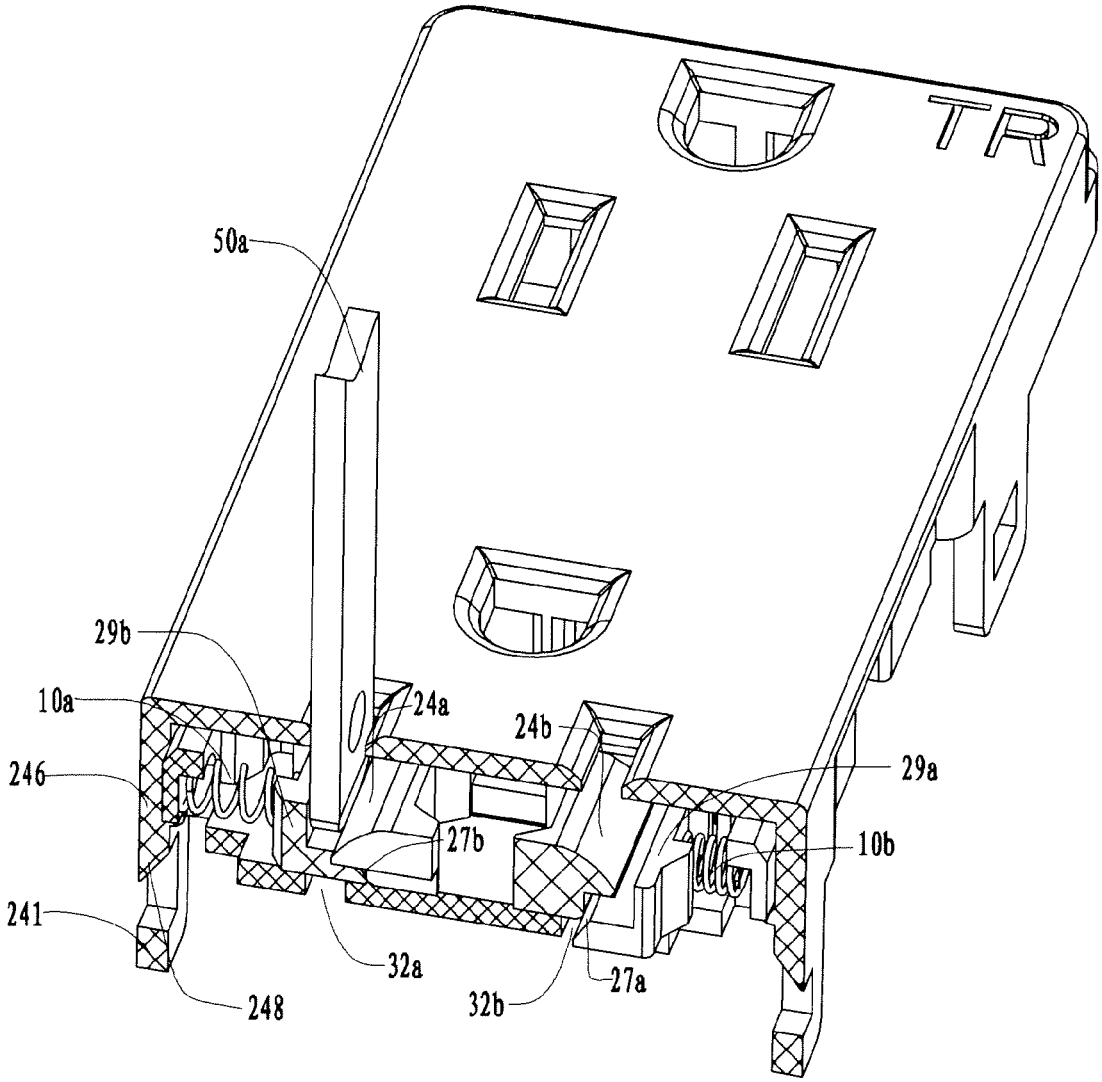
FIG. 19 is an axonometric view of the device of FIG. 18.

FIGS. 6 and 13 illustrate plan views of different examples of cover assemblies that can be used with the protective shutter assembly 1 shown in FIG. 2. It is noted that the cover assemblies may have any suitable configuration and should not be limited to those shown and described herein. As shown in FIGS. 6 and 13, embodied in the upper cover 46, 246 of the receptacle are a hot receptacle opening 44, 244, a neutral receptacle opening 43, 243 and a grounding receptacle opening 45, 245. The cover 46, 246 can also include an alignment key 42, 242 and two retaining walls 47, 247 to retain the protective shutter assembly 1 of FIG. 2 in the cover assembly 46, 246. FIG. 7 illustrates one example of the protective shutter assembly 1 retained in the cover 46 of FIG. 6.

Figure 24:
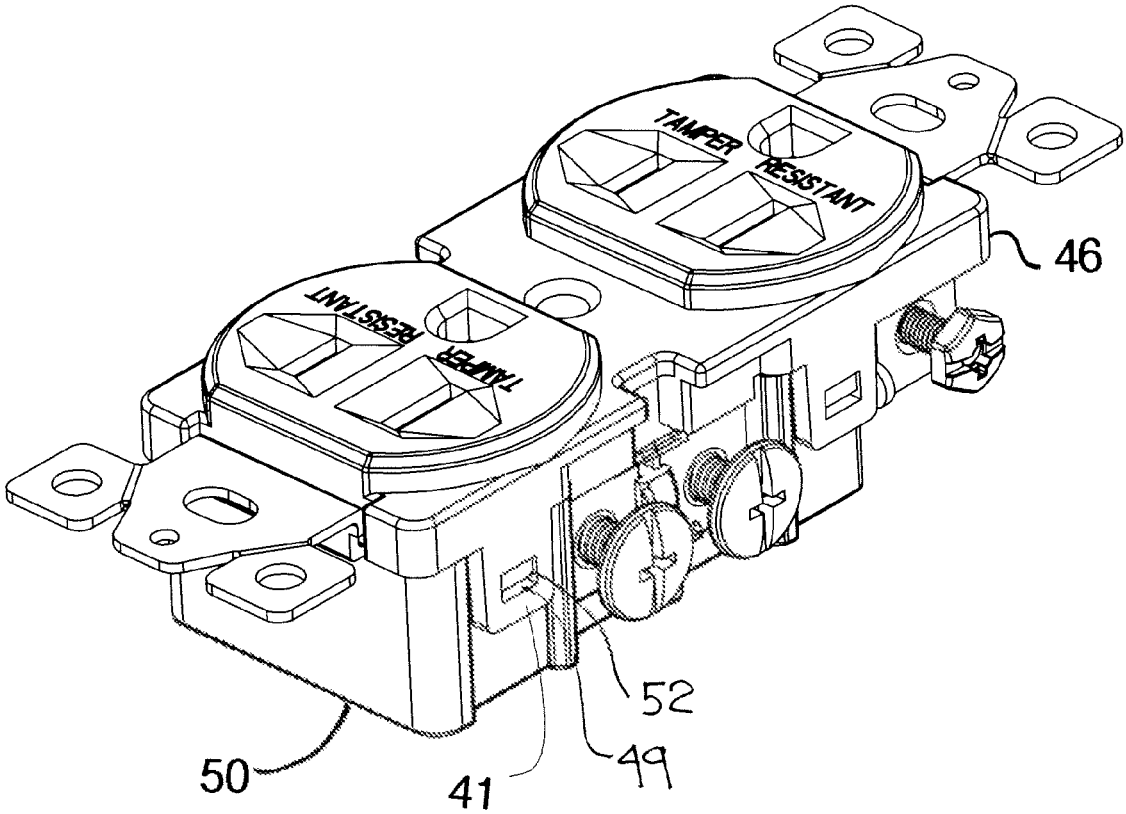
FIGS. 24 and 25 are illustrations of exemplary plug assemblies including the protective shutter assembly of the disclosed embodiments.
Figure 25:
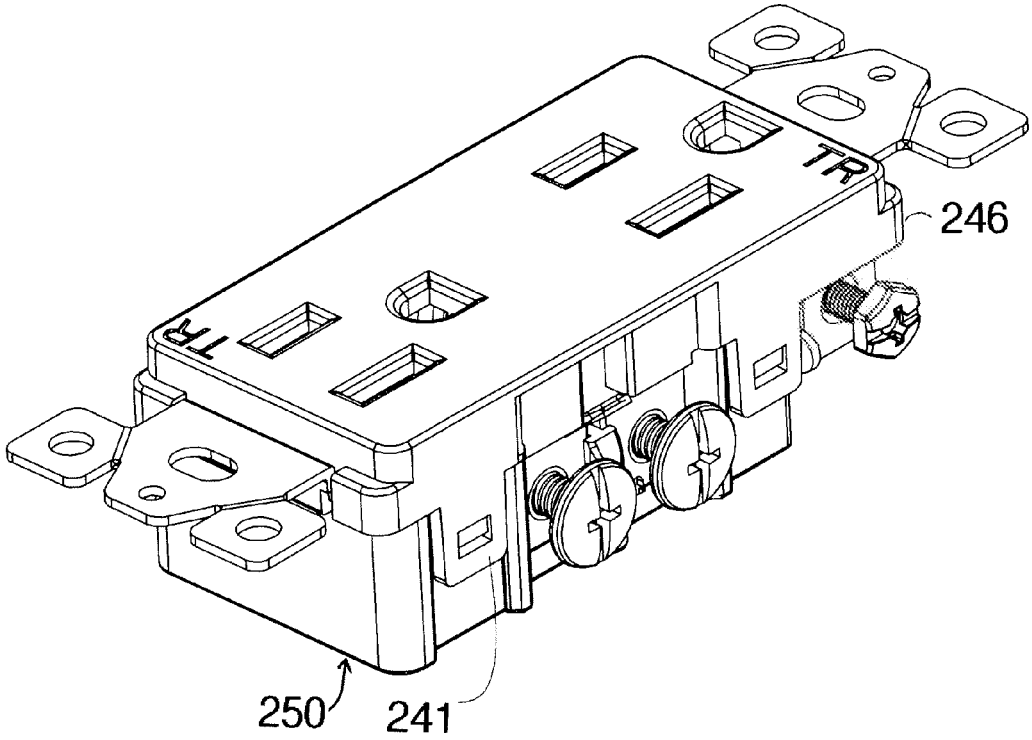

In one embodiment, the retaining member 40, 240 fixes the protective shutter assembly 1 of FIG. 2 in the cover 46, 246. The retaining member 40, 240 is configured to be received in the installation pocket 33 to retain the registration member 34 in the cover assembly 46. As shown in FIGS. 24 and 25, the installation latch 41, 241 is used to fix the cover 46, 246 to the base 50, 250 of the main body of the receptacle. Each installation latch includes opening 49, 249 (FIG. 13). Opening 49 is configured to engage retaining member 52 shown in FIG. 24. In other embodiments the cover 46, 246 may be coupled, either removably or fixedly, to the main body 50, 250 in any suitable manner including, but not limited to, adhesives, ultrasonic welding or mechanical fasteners.

Figure 8:
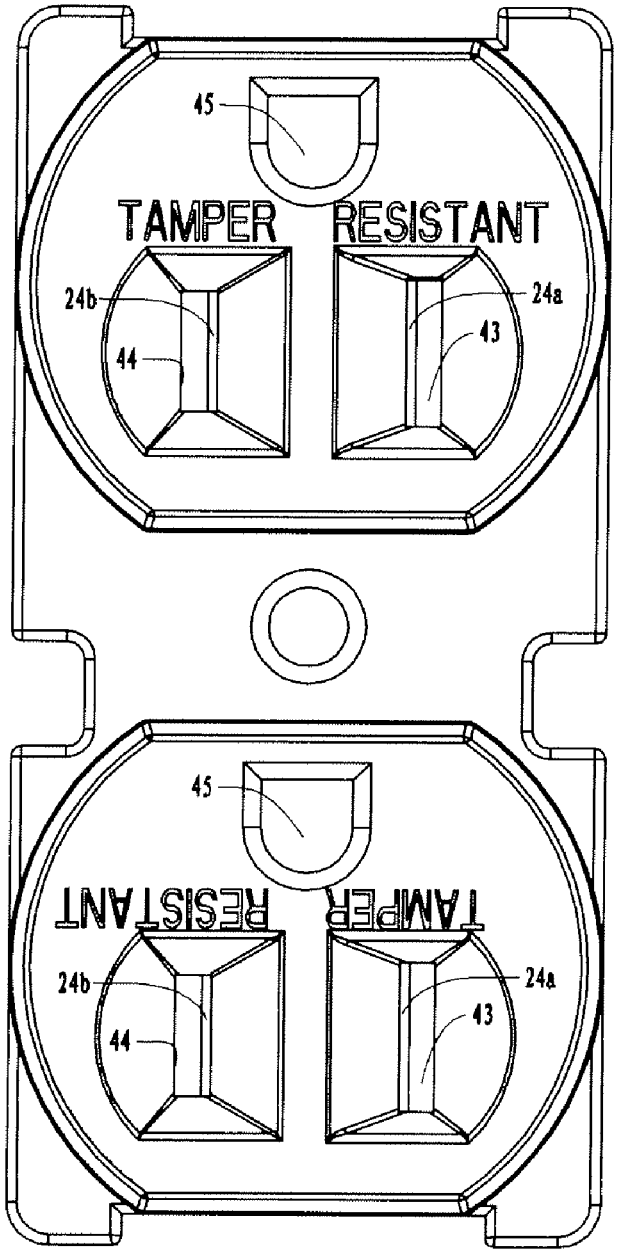
FIG. 8 is a plan view of the external portion of the cover assembly shown in FIG. 6 with the protective shutter assembly of FIG. 2 embodied therein.
Figure 9:
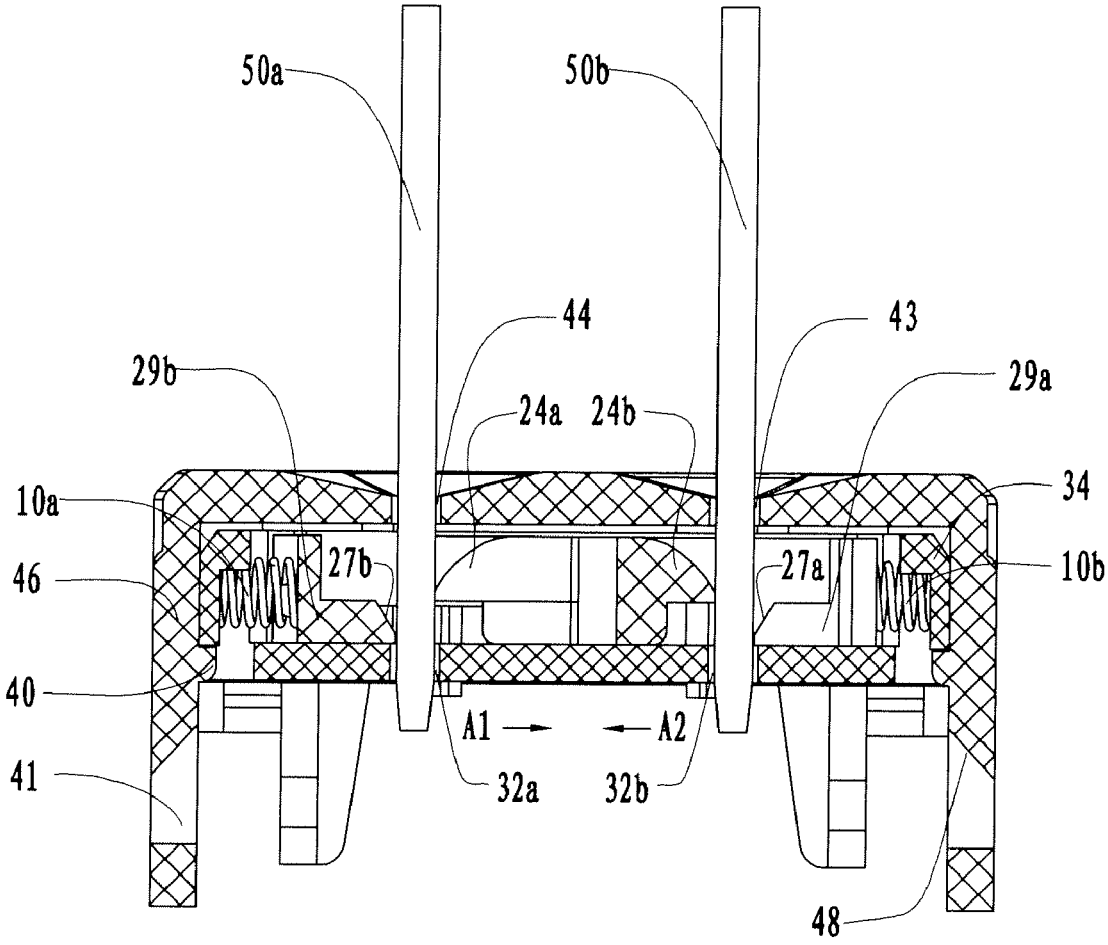
FIG. 9 is a cross-sectional view of one example of an electrical receptacle device including a protective shutter assembly with plug blades inserted into each of the receptacle openings.

FIG. 8 is a plan view of the external portion of the cover assembly shown in FIG. 6 with the protective shutter assembly of FIG. 2 embodied therein. As shown in FIGS. 8 and 9, the receptacle assembly 800 includes complementary pairs of receptacle openings 43, 44 for exemplary purposes only. In alternate embodiments, a receptacle assembly 800 can include any suitable number of receptacle openings.

FIG. 9 is a cross-sectional view of one example of an electrical receptacle device, such as assembly 800 shown in FIG. 8, including a protective shutter assembly with plug blades 50*a*, 50*b* inserted into each of the receptacle openings 44, 43, respectively. When a pair of plug blades 50*a*, 50*b* is inserted into each respective receptacle opening, 44, 43, substantially simultaneously, the protective shutter assembly 1 is configured to allow the blades 50*a*, 50*b* to pass through the receptacle openings, 44, 43 as will be described in greater detail below. This allows the blades 50*a*, 50*b* to establish an electrical connection with a supply source or receptacles (not shown).

However, the aspects of the disclosed embodiments will effectively prevent the insertion of only one plug blade, or foreign object, into only one of the openings. When such an attempt is made, the protective shutter assembly 1 of FIG. 2 will block both receptacle openings 43, 44.

Referring also to FIG. 22, before the plug element 50*a* is inserted into one of the receptacles the shutter members 29*a*, 29*b* are in an initial or neutral, such as that shown in FIG. 22. In this initial position, the blocking members 27*a*, 27*b*, or receptacle blocking members, of each shutter member 29*a* and 29*b*, block each of the respective openings 32*a* and 32*b*. In one embodiment, in the initial position the shutter members 29*a*, 29*b* are substantially symmetrically located about centerline C of the registration member 34. The resilient members 10*a*, 10*b* may be configured such that the forces exerted on their respective shutter members 29*a*, 29*b* are substantially equal so that the resultant force exerted by the resilient members 10*a*, 10*b* place the shutter members as shown in FIG. 22 when the springs are at equilibrium. In another embodiment the recesses 26*b*, 26*c* along with the resilient members may serve to position the shutter members 29*a*, 29*b* in the initial position through interaction between the longitudinal orbits 26 and the recesses 26*b*, 26*c*.

Figure 11:
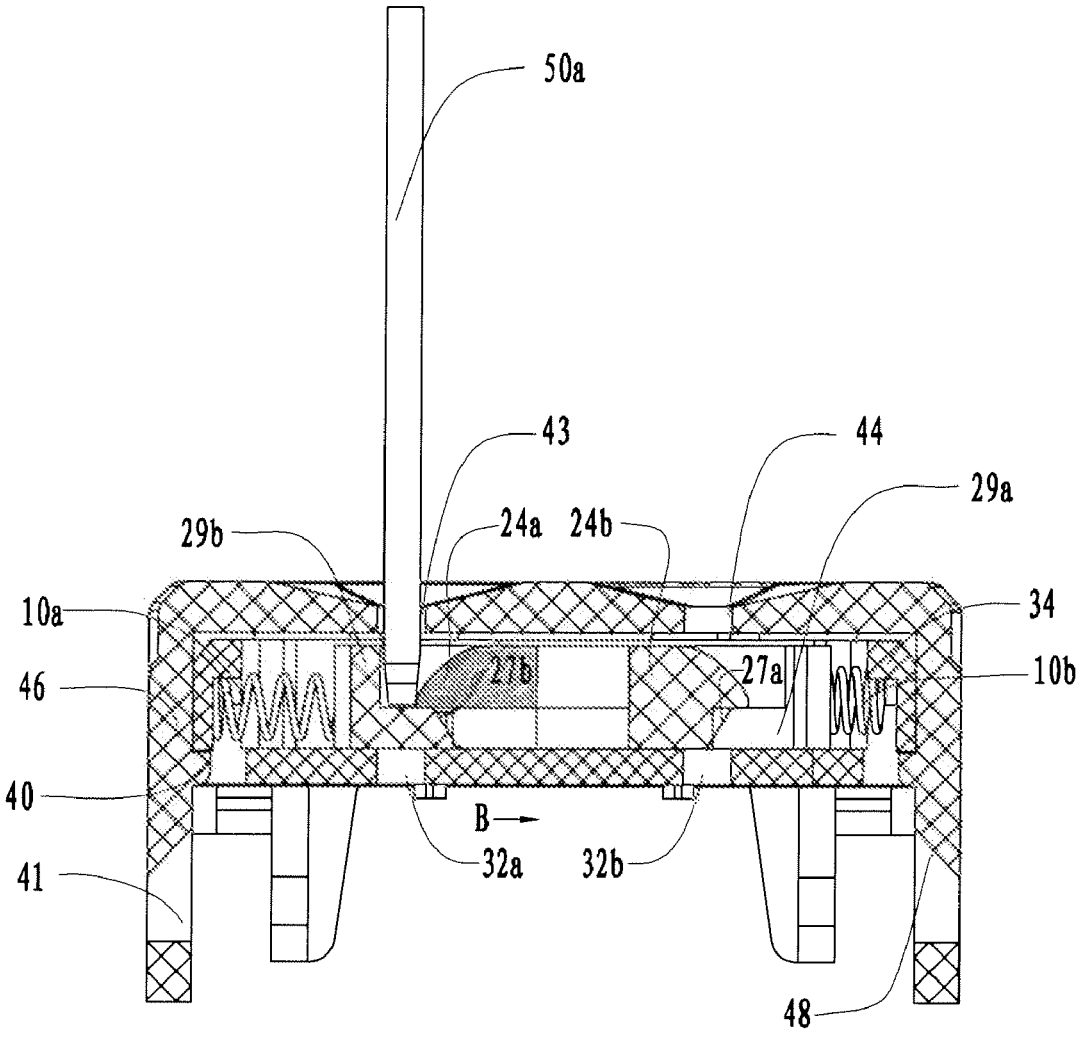
FIG. 11 is a cross-sectional view of the device of FIG. 8 with only one plug blade inserted into only one receptacle opening.
Figure 12:
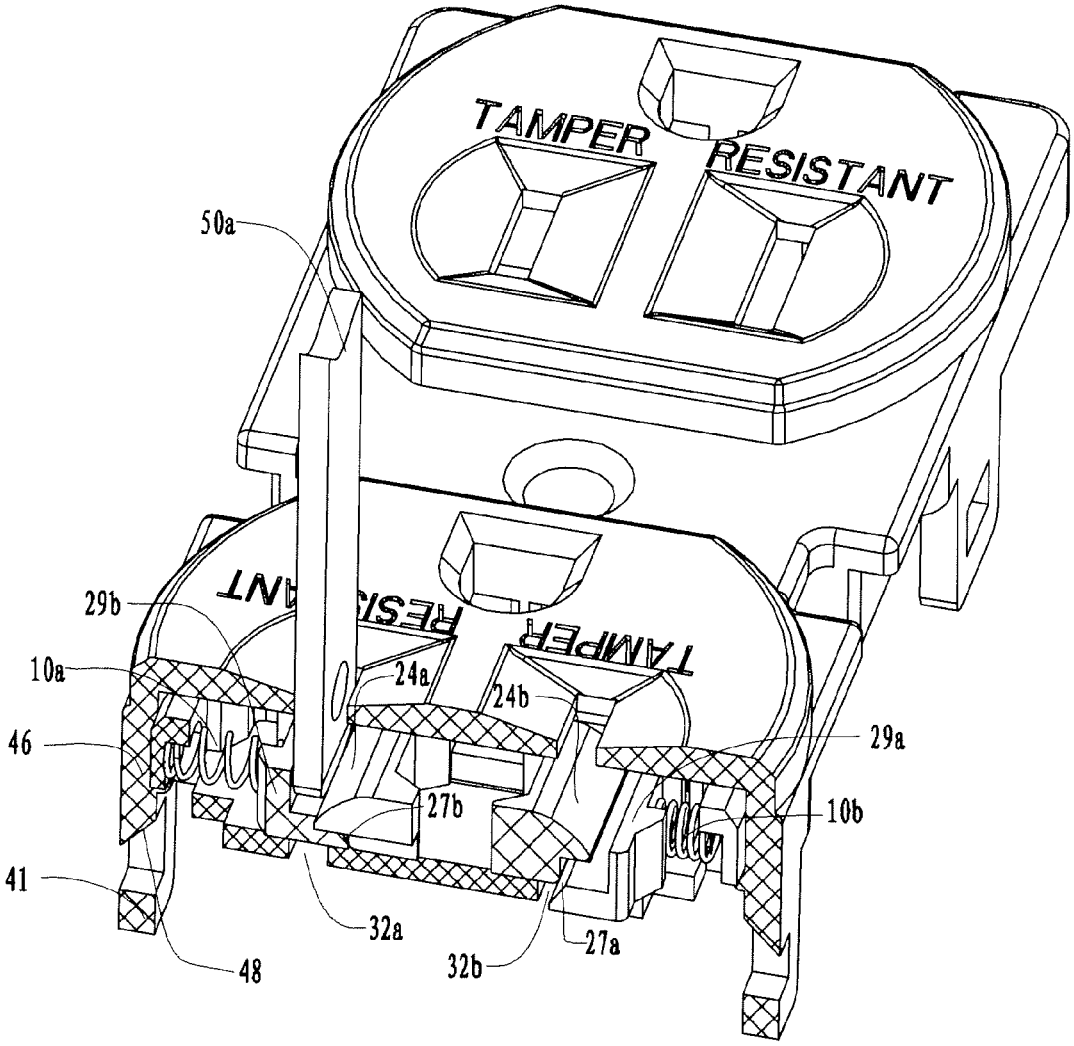
FIG. 12 is a axonometric view of the device shown in FIG. 11.
Figure 23:
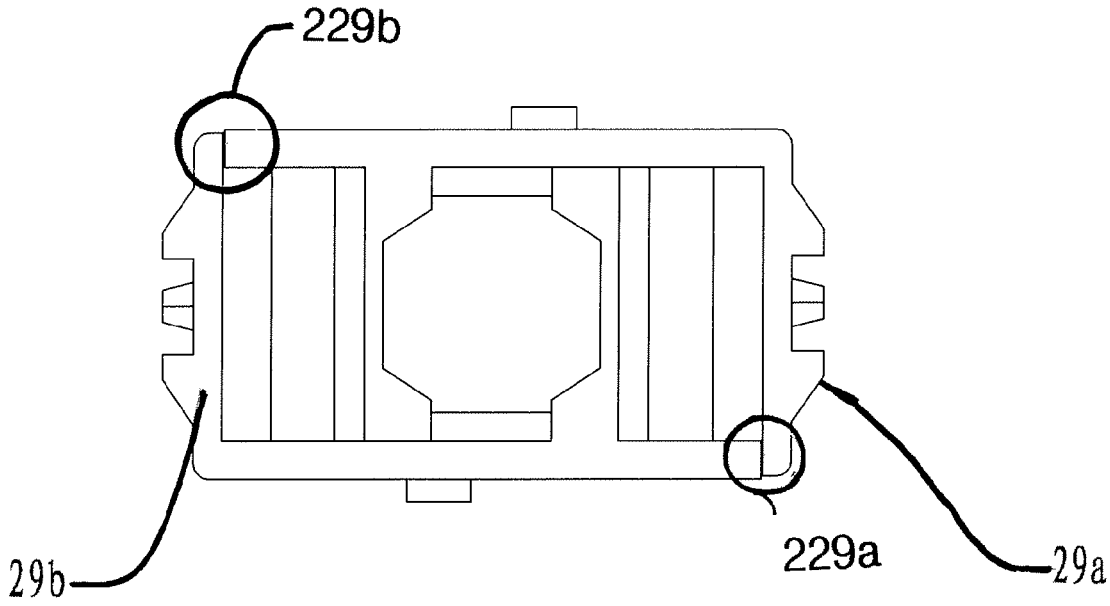
FIG. 23 is a plan view of a shutter member assembly.

Referring to FIGS. 11 and 12, an example where an attempt is made to insert a single plug blade 50*a* into receptacle 43 of the protective shutter assembly 1 is shown. As the plug 50*a* is inserted into receptacle 43 through the upper cover 46, 246, for example, the plug element 50*a* encounters ramp 24*a*. The ramp member 24*a* is configured such that the force of the plug element 50*a* exerted on the surface of the ramp 24*a* in the direction of arrow F causes the shutter member 29*a* to move in the direction B shown in FIG. 11. The movement of shutter member 29*a* in the direction B causes shutter member 29*a* to compress resilient member 10*b*. As shutter member 29*a* moves in the direction B, it comes into contact with, or is substantially urged against shutter member 29*b*, which is, at this point, in a stationary position. In one embodiment width W (See FIG. 20) of each ramp member 24*a*, 24*b* is suitably sized so that when shutter 29*a* is moved in the direction of B to is most extreme position the backs 24*e* (See FIG. 20) of the ramp members substantially contact each other. As shutter 29*a* moves in the direction B, resilient member 10*a* extends and exerts a force on shutter member 29*b* in the direction of B. Referring to FIG. 23, an example of the interaction of members 29*a* and 29*b* is illustrated. As shown in the figure, members 29*a* and 29*b* contact each other at points 229*a* and 229*b*.

In one embodiment, the movement of shutter member 29*b* in the direction B causes shutter blocking member 27*b* to block the polarity receptacle opening 32*a* while the substantial contact between the backs 24*e* of the ramp members 24*a*, 24*b* prevents movement of the blocking member 27*b* in a direction opposite that of direction B.

As shown in FIG. 11, blocking member 27*b* prevents plug element 50*a* from progressing any further into the receptacle 43 by blocking opening 32*a*. Receptacle 44 also is blocked by the combination of ramp 24*b* and shutter blocking member 27*a*, which cover or block opening 32*b*. This effectively avoids or prevents the danger of foreign objects being inserted in a receptacle contact opening and making an electrical connection, which can cause electric shock hazard. Although this example has been described with the use of plug element 50*a*, it will be understood that the blocking mechanism of the protective shutter assembly of the disclosed embodiments will react similarly to insertion of any suitable object into only one of the two openings 43, 44.

The configuration of the shutter members 29*a*, 29*b* to substantially contact each other in the manner described above prevents the sequential insertion of objects into the openings 43, 44. It is only when two suitable elements, such as elements 50*a* and 50*b*, are substantially simultaneously inserted into the openings 43, 44, that the respective shutter members 29*a*, 29*b* will move sufficiently to allow the elements 50*a*, 50*b* to pass by blocking members 27*b*, 27*a* and into the corresponding polarity receptacle opening 32*a*, 32*b*. It is noted that the width W of the ramp members 24*a*, 24*b* is configured to allow a predetermined amount of travel in opposite directions so that both ramp members 24*a*, 24*b* and both blocking members 27*a*, 27*b* are clear of the openings 32*a*, 32*b*, 43, 44 when objects are substantially simultaneously inserted into both opening 43, 44 as shown in, for example FIG. 9.

Figure 10:
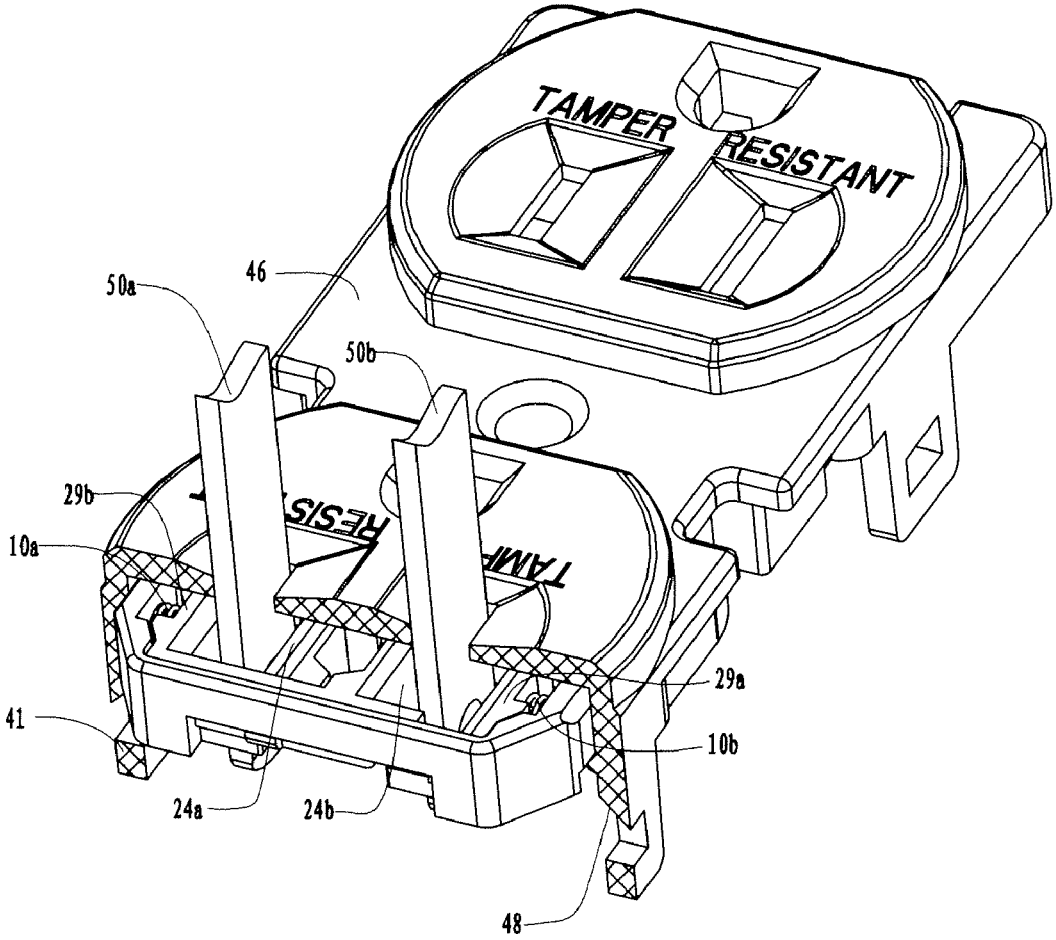
FIG. 10 is a axonometric view of the electrical receptacle device including the protective shutter assembly shown in FIG. 9 with plug blades inserted into each of the receptacle openings.

Referring to FIGS. 9 and 10, when the receptacle is in use, plug blades 50*a* and 50*b* are inserted into the neutral receptacle opening 43, 243 and the hot receptacle opening 44, 244 respectively through the cover 46, 246. The neutral receptacle opening 43, 243 and hot receptacle opening 44, 244 of the cover 46, 246 substantially align to the respective polarity receptacle openings 32*a*, 32*b* of the registration assembly 34. FIGS. 9 and 10 illustrate an example where two plug elements 50*a*, 50*b* have been substantially simultaneously inserted into corresponding receptacle openings 44, 43. As shown in FIG. 9, as plug blades 50*a*, 50*b* are being substantially simultaneously inserted into the respective receptacle openings 43 and 44, each plug blade 50*a*, 50*b* first arrives at a respective shutter ramp 24*a*, 24*b*. Continued insertion of the plug blades 50*a*, 50*b* will cause each shutter ramp member 24*a*, 24*b* to move or slide in respective opposing directions A1, A2 within the registration member 34. This moves the shutter members 29*a* and 29*b* in opposing directions far enough to allow plug blade 50*a*, 50*b* to extend through the polarity receptacle opening 32*a*, 32*b* on the registration assembly 34. Movement of the shutter members 29*a*, 29*b* also causes the compression of resilient members 10*a* and 10*b*. The shutter blocking members 27*a* and 27*b* also move in opposing respective directions A1, A2. This opens access to polarity receptacle openings 32*a* and 32*b* as can be seen in FIG. 9. Each plug element 50*a* and 50*b* can pass through the respective polarity opening 32*a*, 32*b* and enable an electrical connection with one of, for example, a hot or neutral power receptacle of connector. It is noted that when the plug blades 50*a*, 50*b* are pulled out, the shutters 29*a*, 29*b* return to the initial, closed position, from for example forces exerted on the respective shutter members 29*a*, 29*b* by the resilient members 10*a*, 10*b*. By returning the shutter members 29*a*, 29*b* to the initial position, the neutral receptacle opening 43, 243 and the hot receptacle opening 44, 244 are blocked again.

In one embodiment, the receptacle can include two sets of six receptacle contact openings configured to accommodate two sets of six plug blades with a predetermined plug blade geometry. A plurality of receptacle contacts is disposed in the device, each of the plurality of receptacle contacts being in communication with a corresponding one of the two set of receptacle openings. The protective shutter assembly is disposed in the cover assembly, and the registration structure in the cover will position and align the protective shutter assembly within the cover assembly. Ultrasonic welding and four installation cover latches can be to used complete the device, to provide a firm product structure.

The aspects of the disclosed embodiments provide an electrical receptacle with a protective shutter where the shutter sub-assembly inside one receptacle opening will open only when the other receptacle opening is inserted, substantially simultaneously, with a plug blade having a predetermined plug blade geometry, and then with the push of the spring, the shutter sub-assembly will finally turn to open position. This approach effectively prevents the hidden danger of foreign objects insertion into one of the receptacle contact opening which will cause electric shock hazard.

It should be understood that the foregoing description is only illustrative of the embodiments. Various alternatives and modifications can be devised by those skilled in the art without departing from the embodiments. Accordingly, the present embodiments are intended to embrace all such alternatives, modifications and variances that fall within the scope of the appended claims.

What is claimed is:

1. An apparatus comprising:

a cover assembly for a protective shutter assembly, the cover assembly including at least one alignment key and at least one pair of opposing retaining walls;

at least one registration member including a back wall, opposing top and bottom wall members and opposing side wall members to form a frame, the at least one registration member configured to be removably retained in the cover assembly within the at least one pair of opposing retaining walls and aligned within the cover assembly by the at least one alignment key;

a shutter device movably secured within the at least one registration member, the shutter device being configured to simultaneously block openings for at least a hot connector element and a neutral connector element of an electrical receptacle when forces are unequally applied to the shutter device through openings corresponding to the at least hot and neutral connector elements, the shutter device including a pair of opposing retaining orbits that are configured to be slidingly engaged in corresponding recesses in the opposing top and bottom wall members of the at least one registration member to retain the shutter device in the at least one registration member; and at least one retaining member in the cover assembly, each retaining member configured to engage an installation pocket in each opposing side wall member of the at least one registration member to retain the at least one registration member in the cover assembly.

2. The apparatus of claim 1, wherein the shutter device is configured to provide access to both the at least hot and neutral connector elements of the electrical receptacle when forces exerted on the shutter device through each of the corresponding openings are substantially balanced.

3. The apparatus of claim 1, wherein the shutter device comprises:

a first shutter member slidingly mounted in the at least one registration member, the first shutter member having a first ramp member and a first receptacle blocking member;

a second shutter member slidingly mounted in the at least one registration member, the second shutter member having a second ramp member located in front of the first blocking member and a second receptacle blocking member located behind the first ramp member; and a first resilient member disposed between the first shutter member and a side wall of the at least one registration member and a second resilient member disposed between the second shutter member and the other side wall of the at least one registration member;

wherein the first and second shutter members are configured to simultaneously block a neutral and hot opening of the electrical receptacle-when a force is exerted on only one of the first or second ramp members.

4. The apparatus of claim 3, wherein when the force is substantially simultaneous exerted on both of the first and second ramp members, the first and second shutter members slide in opposite directions allowing an object or objects exerting the force to pass through the shutters.

5. The apparatus of claim 1 further comprising at least one longitudinal retaining pocket on the shutter device, each longitudinal retaining member configured to be received in a corresponding retaining orbit of the shutter device, each longitudinal retaining pocket being configured to move longitudinally in the corresponding retaining orbit and prevent skewing movement of the shutter device within the registration member.

6. An apparatus comprising:

at least one registration member having opposing top and bottom walls and opposing side walls to form a frame, each registration member configured to be separately and removably inserted into a housing for an electrical receptacle;

a first shutter member slidingly mounted in the frame, the first shutter member having a first ramp member and a first receptacle blocking member;

a second shutter member slidingly mounted in the frame, the second shutter member having a second ramp member located in front of the first blocking member and a second receptacle blocking member located behind the first ramp member; wherein each shutter member includes a longitudinal retaining member configured to be received in a shutter orbit in the frame to retain each shutter member in the frame and allow longitudinal sliding movement of each shutter member within the frame; and a first resilient member disposed between the first shutter member and the frame and a second resilient member disposed between the second shutter member and the frame; and at least one angled wall member in each corner of the frame configured to limit movement of the first and second shutter member within the frame;

wherein the first and second shutter members are configured to simultaneously block a neutral and hot opening of the electrical receptacle when a force is exerted on only one of the first or second ramp members.

7. The apparatus of claim 6 wherein a separate registration member is provided for each pair of receptacle openings in the electrical receptacle.

8. The apparatus of claim 7 wherein each registration member further comprises a pair of retaining members, each retaining member configured to engage an installation pocket on each end of the registration member to retain the registration member in the housing.

9. The apparatus of claim 6, wherein when the force is exerted on only one of the first or second ramp members a combination of the force and a respective one of the first and second resilient members causes the first and second shutter members to slide in the same direction within the frame.

10. The apparatus of claim 9, wherein movement of the first and second shutter members in the same direction causes blockage of one of the neutral or hot openings of the electrical receptacle by moving a feed ramp of a respective one of the first and second blocking members away from the one of the neutral or hot openings to position the blocking member over the one of the neutral or hot openings.

11. The apparatus of claim 10, wherein movement of the first and second shutter members in the same direction causes blockage of the other one of the neutral or hot openings by moving another one of the first and second ramp members so that the other one of the first and second ramp members and another one of the blocking members are located over the other one of the neutral or hot openings.

12. The apparatus of claim 9, wherein the first and second shutter members are configured to provide access to both the neutral and hot openings of the electrical receptacle when a force is exerted on both of the first and second ramp members.

13. The apparatus of claim 12, wherein when the force is exerted on both of the first and second ramp members, the first and second shutter members slide in opposite directions allowing an object or objects exerting the force to pass through the shutters.

14. The apparatus of claim 12, wherein the first and second ramp members and first and second blocking members are configured to allow passage of an object or objects exerting the force only when the forces on the first and second ramp members are substantially balanced.

15. An electrical receptacle comprising:

a housing for providing at least a hot and neutral receptacle to a power source;

a cover attached to the housing having at least a first and second openings for allowing connection to a corresponding one of the hot or neutral receptacle; and at least one registration member located within the housing, each registration member being configured to block both the first and second openings of a respective receptacle when forces are unequally applied to the shutter device through the first and second openings, wherein each registration member is individually affixed in the housing and comprises:

a first shutter member slidingly mounted in a registration member, the first shutter member having a first ramp member and a first receptacle blocking member;

a second shutter member slidingly mounted in the registration member, the second shutter member having a second ramp member located in front of the first blocking member and a second receptacle blocking member located behind the first ramp member;

wherein each shutter member includes a longitudinal retaining member configured to be received in a shutter orbit corresponding top and bottom walls of the registration member to retain each shutter member in the registration member and allow longitudinal sliding movement of each shutter member within the registration member;

a first resilient member disposed between the first shutter member and the frame and a second resilient member disposed between the second shutter member and the registration member; and at least one angled wall member in each corner of the registration member configured to limit movement of the first and second shutter member;

wherein the first and second shutter members are configured to simultaneously block a neutral and hot opening of the respective electrical receptacle when a force is exerted on only one of the first or second ramp members.

16. The electrical receptacle of claim 15, wherein the registration member is configured to provide access to both the neutral and hot receptacles when a force is exerted on the shutter device through both of the first and second openings.

17. The selectrical receptacle of claim 16, wherein the registration member is configured to allow passage of an object or objects through the first and second openings only when the forces exerted on the shutter device through each of the first and second openings are substantially balanced.

18. The electrical receptacle of claim 17, wherein when a force is exerted on both of the first and second ramp members, the first and second shutter members slide in opposite directions allowing an object or objects exerting the force to pass through the shutters and contact the at least hot and neutral receptacles.

19. The electrical receptacle of claim 17, wherein when the force is exerted on only one of either the first or second ramp members a combination of the force and a respective one of the first and second resilient members causes the first and second shutter members to slide in the same direction within the frame.

20. The electrical receptacle of claim 19, wherein movement of the first and second shutter members in the same direction causes blockage of one of the at least neutral or hot receptacles by moving a feed ramp of a respective one of the first and second blocking members away from the one of the at least neutral or hot receptacles to position the blocking member over the one of the at least neutral or hot receptacles.

21. The apparatus of claim 20, wherein movement of the first and second shutter members in the same direction causes blockage of the other one of the at least neutral or hot receptacles by moving another one of the first and second ramp members so that the other one of the first and second ramp members and another one of the blocking members are located over the other one of the at least neutral or hot receptacles.

* * * * *